United States Patent [19]

Harrison

[11] 4,359,845

[45] Nov. 23, 1982

[54] MOISTURE BARRIER SYSTEM FOR EARTH-SHELTERED HOUSING

[76] Inventor: Bill L. Harrison, 659 S. Prairie St., Frankfort, Ind.

[21] Appl. No.: 172,136

[22] Filed: Jul. 25, 1980

Related U.S. Application Data

[63] Continuation-in-part of Ser. No. 129,684, Mar. 12, 1980, abandoned.

[51] Int. Cl.[3] ..... E02D 29/00

[52] U.S. Cl. ..... 52/169.6; 52/220; 52/302

[58] Field of Search ..... 52/220, 309.8, 309.9, 52/303, 365, 678, 515, 408, 169.6, 169.14, 300, 302

[56] References Cited

U.S. PATENT DOCUMENTS

| | | | |
|---|---|---|---|
| 741,589 | 10/1903 | McBean | 52/408 |
| 1,710,484 | 4/1929 | Luther | 52/300 |
| 2,083,491 | 6/1937 | Chaffee | 52/269 |
| 2,271,143 | 1/1942 | Martinus | 52/265 |
| 2,365,785 | 12/1944 | Tinnerman | 285/192 |
| 2,823,539 | 2/1958 | Kersh et al. | 52/678 |
| 2,899,771 | 8/1959 | Burris | 52/169.14 |
| 3,093,934 | 6/1963 | Underhill | 52/309.8 |
| 3,115,726 | 12/1963 | Sayles | 52/365 |
| 3,294,001 | 12/1966 | Thomson . | |
| 3,299,786 | 1/1967 | Godbersen . | |
| 3,455,076 | 7/1969 | Clarvoe | 52/408 |
| 3,468,741 | 9/1969 | Pedlow | 52/309.9 |
| 3,566,568 | 3/1971 | Slobodian | 52/309.9 |
| 3,646,720 | 3/1972 | Watts | 52/303 |
| 3,725,185 | 4/1973 | Curtis | 52/309.9 |
| 3,953,974 | 5/1976 | Bresson et al. | 52/169 |
| 4,041,241 | 8/1977 | Olmstead et al. | 248/56 X |
| 4,086,736 | 5/1978 | Landrigan | 52/221 |
| 4,115,976 | 9/1973 | Rohrer | 52/741 |
| 4,237,667 | 12/1980 | Pallucci et al. | 248/56 X |

FOREIGN PATENT DOCUMENTS

| | | | |
|---|---|---|---|
| 52327 | 9/1936 | Denmark | 285/192 |
| 999541 | 10/1951 | France | 52/265 |
| 598406 | 2/1948 | United Kingdom | 52/220 |
| 632288 | 11/1949 | United Kingdom | 52/265 |
| 975604 | 11/1964 | United Kingdom | 52/515 |

OTHER PUBLICATIONS

Earth Sheltered Housing Design, Prepared by Underground Space Center, Univ. of Minn. 1978, Van Nostrand Reinhold Co., New York, pp. 131–134, 138–143.

Construction Methods and Equipment, Mar., 1955, p. 87.

Engineering News Record, Jun. 27, 1957, p. 71.

*Primary Examiner*—James L. Ridgill, Jr.

*Attorney, Agent, or Firm*—Woodard, Weikart, Emhardt & Naughton

[57] ABSTRACT

A moisture barrier system for earth-sheltered housing and similar earth-contacted surfaces includes a laminated construction of "Styrofoam" and polyvinylchloride film which is adhesively joined to all exterior surfaces of the housing which are covered by earth. The polyvinylchloride film is provided in sheet form and adjacent sheets are arranged with an overlapping joint of approximately four inches and adhesive sealant is applied to each surface of the joint. Adhesive sealant is used to mount the "Styrofoam" to the poured concrete walls of the housing structure and a similar sealant is used to apply the polyvinylchloride film to the "Styrofoam". At each entry location of pipes and conduits, a pair of conduit seal assemblies are located. Each seal assembly is arranged into two longitudinally split halves which define a central conduit passageway extending therethrough. The two halves are held together around the corresponding conduit by a steel band clamp. Each seal assembly has an enlarged base portion which is adhesively joined to the polyvinylchloride film and the conduit passageway is similarly coated with adhesive sealant to provide a water-tight construction around the conduit.

10 Claims, 7 Drawing Figures

MOISTURE BARRIER SYSTEM FOR EARTH-SHELTERED HOUSING

CROSS-REFERENCE TO RELATED APPLICATION

This application is a continuation-in-part patent application of application Ser. No. 129,684 filed Mar. 12, 1980, now abandoned.

BACKGROUND OF THE INVENTION

This invention relates in general to construction concepts and in particular to earth-sheltered structures and means for providing an effective moisture barrier for such structures.

The concept of earth-sheltered structures, specifically houses, has begun to increase in acceptance by builders as well as by purchasers. The advantages of lower construction costs and lower maintenance costs have become quite attractive due to inflation and the increasing cost spiral of home construction.

The concept, as its name suggests, involves the use of earth to surround and shelter portions of the structure. For example, a house built into a hillside may only have one or two exterior walls exposed to the elements while the remainder of the house is covered by earth. As one might imagine, the surrounding earth serves as an excellent insulator from either hot or cold and the inner depths of the hillside represent a desirable heat sink which remains warmer than the atmosphere in cold weather and cooler than the atmosphere in warm weather.

Earth-sheltered housing begins by excavating a large void in the hillside and extending inwardly and upwardly from the ground level at the base of the hillside. The floor, ceiling (roof) and side walls are constructed of poured concrete and provide both an extremely strong as well as durable method of construction. Although overhanging portions of the hillside may give way when the excavating is performed, the earth is merely replaced atop the finished roof and against the sides of the structure in a type of hillside rebuilding effort after the structure construction is concluded. Due to the fact that a layer of earth covers the roof, the need for roof repair, typically caused by the elements, such as adding a new layer of shingles, is eliminated. Similarly, the need to paint the exterior is limited to the front of the structure and possibly a portion of a side wall, depending upon the particular style of house selected.

So long as the surrounding hillside is adequately covered with grass or shrubbery or similar plantings, erosion will not be a concern. In order to retain that portion of earth which rests atop the roof of the structure, the exposed edges of the roof are provided with a parapet wall of concrete. With respect to erosion and the associated rainfall, since earth-sheltered housing does not have a conventional roof, it also does not have gutters and downspouts. For this reason, rainfall and collected moisture represent a more significant concern than with conventional construction methods. It is extremely important that earth-sheltered housing be provided with an extremely durable and reliable moisture barrier system for the attempted water-proofing of the roof, floor and side walls. Although various waterproofing and moisture barrier techniques are known to exist, none are believed to be effective for earth-sheltered housing due in part to their method of application and arrangement and in part to the higher moisture content which is present with earth-sheltered housing and the need for greater waterproofing capabilities. In addition to the possibility of moisture entering the structure by way of seepage through the walls or floors or roof, there is also a concern that moisture can enter around pipes and conduits which must pass into the structure for providing such services as plumbing, electricity and gas. Related to the finished configuration are the construction methods and techniques necessary to arrive at the final structure. The following listed disclosures relate to materials, components and methods associated with construction generally and specifically to attempts at waterproofing structures. Although each disclosure may provide certain benefits, none are anticipatory of the present invention.

| Pat. No. | Patentee |
|---|---|
| 3,953,974 | Bresson et al. |
| 4,086,736 | Landrigan |
| 4,115,976 | Rohrer |
| 3,418,902 | Wilson |
| 3,294,001 | Thomson |
| 3,299,786 | Godbersen |

Publications:

*Construction Methods and Equipment,* March, 1955, page 87;

*Engineering News Record,* June 27, 1957, page 71.

Bresson et al. discloses the composition of an impervious barrier material comprising polyolefin fabric, asphalt and asbestos. The fabric has a fused side placed against the surface to be covered with an unfused side which is coated with a mixture of the asphalt and asbestos.

Landrigan discloses a fire and/or liquid seal associated with the passage of a conduit through a wall. Specifically, the structure is intended for use for preventing the passage of hot gases and flames and although the details of the design may be unique, they are also quite specialized and not believed relevant to use with the earth-sheltered housing described herein.

Rohrer discloses a method for screeding cement floors to a desired level with a self-propelled screeding machine which includes a pair of rails for supporting each side of the screeding machine. The method also involves digging a plurality of holes through the aggregate bed surface and into the ground and then securing by means of poured unsolidified cement an open-ended sleeve in these holes and finally inserting a rail support member telescopically into each sleeve.

Wilson discloses a concrete surface-finishing apparatus having a pair of wheeled carriages which move along a preselected path on opposite sides of a concrete surface. A pair of spaced apart truss frameworks span the concrete surface and are slidably supported in rolling engagement at the opposite ends by rollers on each of the wheeled carriages.

Thomson discloses a concrete-spreading and finishing machine having means for moving longitudinally along a road to be paved. The machine includes a pair of spaced screed supports, jack means for vertically adjusting the screed supports, and means for reciprocating the screeds relative to their supports.

Godbersen discloses a bridge deck finisher which is adapted to be supported on rails and includes a bridge deck-finisher member mounted for movement along the rails. The bridge deck-finisher member includes a transversely positioned framework and lower screed members secured to the framework and suspended therefrom. The screed members are various lengths and are articulated with respect to each other whereby the screed members conform to an upper concrete surface.

The *Construction Methods and Equipment* page discloses the use of plastic film as a moisture barrier. The plastic film involved is polyethylene film of the trade name "VISQUEEN" and is applied to walls by stapling to studs. The maximum thickness is stated to be 0.020 inches. The page also suggests that the film can be placed under concrete slabs and in forms for foundation walls but there is no disclosure as to how this is specifically done.

The *Engineering News Record* page discloses a "VISQUEEN" advertisement and outlines how to keep water out of concrete block foundations for the life of the building. The procedure involves mopping the outer foundation wall with tar and then applying the plastic film and brushing it down to achieve a tight fit.

None of the various disclosures previewed above pertain to waterproofing of earth-sheltered housing, nor do any of the disclosures involve teachings of how to waterproof ceiling slabs or the like. As to those disclosures pertaining to plastic sheet and the use of this material for waterproofing, there is complete silence on how to seal and waterproof the wall at the point of entry in pipes in conduits. As to the disclosure of the Landrigan patent, there is complete silence on how to adapt the seal for pipes and conduits for use with plastic sheets as part of a complete waterproofing arrangement.

The present invention discloses a complete waterproofing system which not only provides a superior moisture barrier to walls, floors and ceilings but also includes novel clamping and seal means to waterproof the points of entry of pipes and conduits into the structure. The disclosed waterproofing system is uniquely adapted for earth-sheltered housing as will be described and discussed hereinafter. Associated with such waterproofing and disclosed as part of the present invention are novel construction aids which enable adaptation of conventional construction techniques to earth-sheltered housing.

SUMMARY OF THE INVENTION

A moisture barrier system for earth-sheltered housing and similar earth-contacted surfaces according to one embodiment of the present invention comprises a plurality of sheets of plastic film applied to the earth-sheltered exterior surface of the housing including the floor, ceiling and side walls, adjacent sheets of plastic film are joined to each other at overlapping joints and a plurality of conduit seal assemblies wherein at least one assembly is located at each point of entry of a conduit into the earth sheltered housing, the conduit seal assemblies are sealingly joined to corresponding sheets of plastic film.

One object of the present invention is to provide an improved moisture barrier system particularly adapted for earth-sheltered housing.

Related objects and advantages of the present invention will be apparent from the following description.

DESCRIPTION OF THE PREFERRED EMBODIMENT

Figure 1:
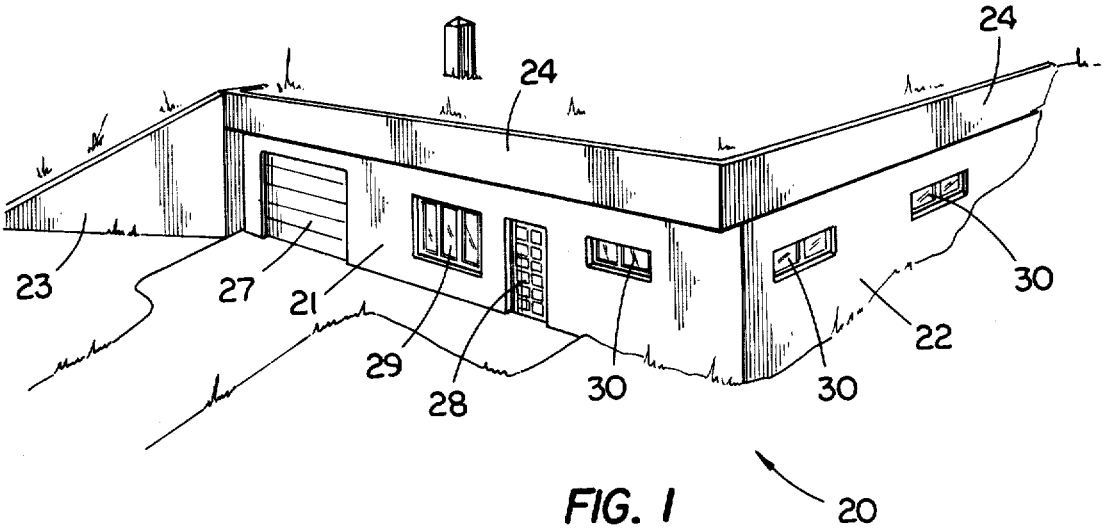
FIG. 1 is a perspective view of an earth-sheltered house according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an earth-sheltered house 20 which has been constructed into a hillside leaving only the front wall 21 and a portion of the right side wall 22 exposed to the elements. Although house 20 is of conventional construction as to many of its features, there are a variety of construction techniques involved which are unique requirements for this type of house. For example, a retaining wall 23 and a parapet wall 24 are needed in order to retain the surrounding earth and eliminate or at least significantly reduce any erosion. Control of erosion is enhanced by the growth of trees, plantings, grass and related ground covers on all hillside areas surrounding the house as well as on the roof of the house.

While front wall 21 and right side wall 22 include such conventional features as a garage door 27, front door 28, window 29 and windows 30, the remaining surfaces of house 20 are completely sealed and covered with earth. The advantages of such earth-sheltered housing include lower construction costs in certain areas, lower maintenance costs to the owner and reduced expenses for heating and cooling. The hillside acts as a heat sink which helps maintain a warmer interior temperature during cold weather and a cooler interior temperature during hotter weather. However, the physical attributes of this hillside which contribute such heat-sinking benefits to the structure have offsetting characteristics. Moisture, both from rainfall and run-off, is retained in the surrounding earth for extended periods of time due to the lack of contact with the air which accelerate evaporation and drying. The earth-covered exterior surfaces of the house are not able to be dried by exposure to sun and wind and this necessitates an exceptional moisture barrier being provided as part of the house construction. Such an exceptional moisture barrier is necessary in order to prevent deterioration of the house walls and ceiling (roof) and to preclude entry of such moisture into the house interior by seepage.

Figure 2:
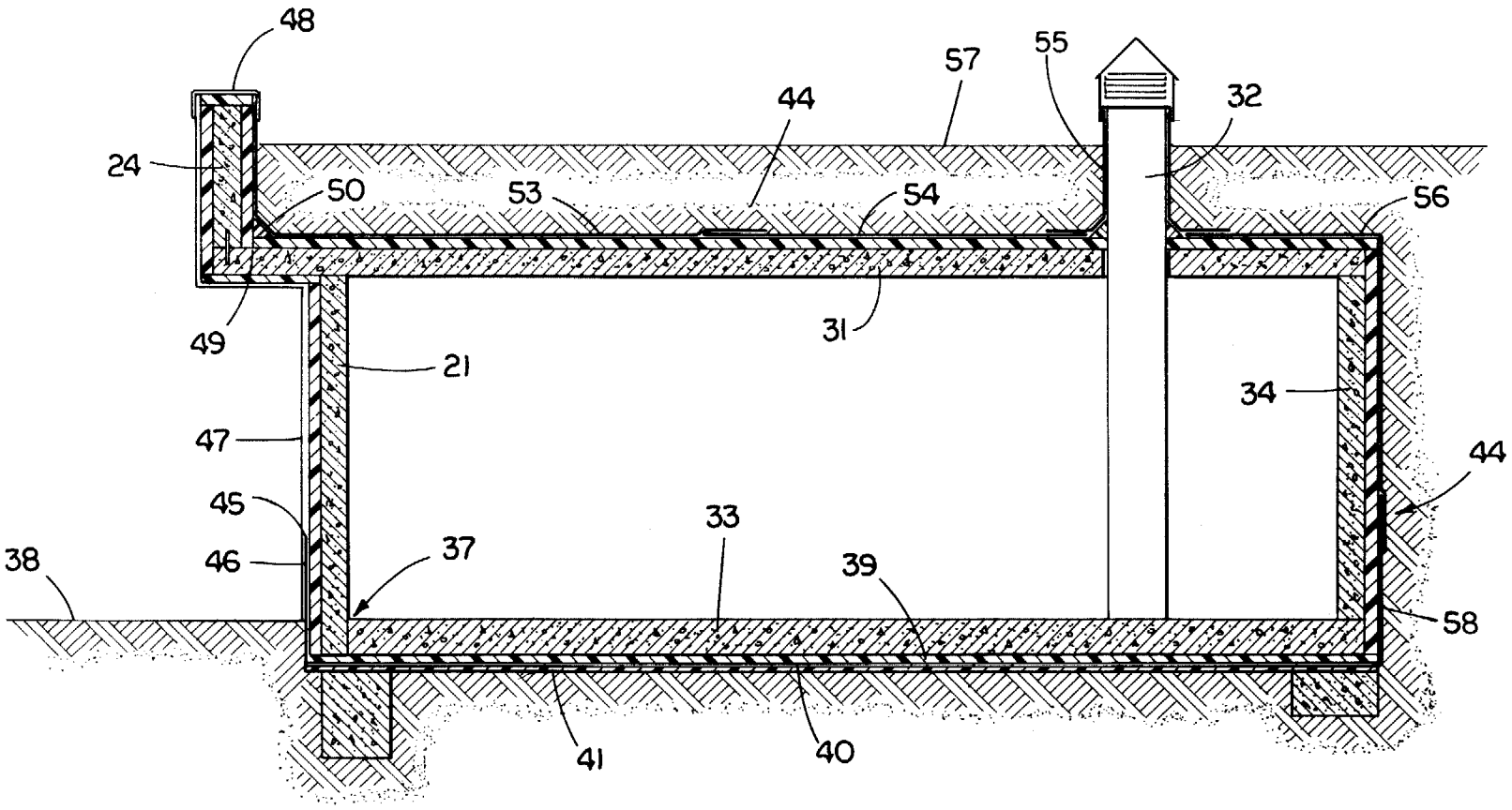
FIG. 2 is a diagrammatic, side elevation section view of the FIG. 1 earth-sheltered house.

Referring to FIG. 2, a moisture barrier system associated with the FIG. 1 earth-sheltered house is illustrated. Although a specific arrangement is detailed, it is to be understood that the moisture barrier (water-proofing) concepts disclosed herein are equally applicable to virtually any horizontal or vertical surface which is contacted by the earth and which is accessible to the contractor at an early point in the construction cycle. Early access is necessary so that the barrier can be properly applied to all structure surfaces which may come in contact with moisture.

FIG. 2 is a diagrammatic representation and is not intended to be limiting, but rather is intended to present a variety of surface and surface interfaces to which the present moisture barrier system is able to be applied. This representation includes a parapet wall 24, roof (ceiling) 31, front wall 21, vent 32, floor 33 and back wall 34. Also included, although not specifically detailed, are the left and right side walls of the house. The particular formation of each joint, such as joint 37 where the front wall 21 joins to the floor 33, may be arranged as illustrated with the floor abutting against the front wall or alternatively with the wall resting on the floor. While there may be practical construction considerations as to which way is preferred, there is virtually no difference with respect to the moisture barrier system to be described in detail hereinafter.

The moisture barrier system of the present invention includes a particular lamination of materials and a particular seam-joining configuration in order to create an impervious, total surrounding moisture barrier. Beneath floor 33, which is poured concrete on a plane level with the exterior grade (line 38), is a first layer of expanded rigid polystryene plastic 39 of the trade name "Styrofoam," approximately one inch thick. Next is a layer of elastomeric, plastic film 40, which is approximately 40 mils thick and finally a foam sheet cushion 41. The moisture barrier is provided primarily by means of plastic film 40 and the material for this film is preferably a polyvinylchloride or associated synthetic material having certain elastomeric properties. Polyetheylene is also suitable but does not have the durability nor the workability of polyvinylchloride. These properties are important because the film must be able to be folded and joined at the seams with adhesive and not puncture, tear or crack. The polyvinylchloride material selected for film 40 is plasticized and treated with ultraviolet resistance and antioxidants.

The foam sheet cushion 41 does not extend up the vertical side walls of the house, but the "Styrofoam" and plastic film are used throughout and are adhesively joined to each other throughout their areas of contact on all wall surfaces. The "Styrofoam" sheets are also adhesively joined to the poured concrete walls to which they are applied. In lieu of "Styrofoam," virtually any rigid cushioning foam could be utilized as part of the present moisture barrier system. Due to manufacturing limitations on the width and length of plastic film 40, consideration must be given to the side-by-side overlapping and the end-to-end overlapping of adjacent sections of film. One seam joint 44 is illustrated as existing on back wall 34 and another joint is configured on roof 31. Similar joints are employed on the sides of house 20 which are earth-covered and the number and spacing of joints depends upon the individual sheet size of film 40. Surfaces which are not covered with earth, such as front surface 21, have only a portion of the surface covered with film 40. The end edges 45 of the front surface film sheets are covered and anchored in place by a suitable exterior covering. Sheets of plastic film 46 extends from beneath floor 33 and are folded upwardly over and around joint 37. This underneath piece extends part way up the front surface of wall 21 and then ends. The free end edges of this plastic film is covered with stucco 47. The height of end edge 45 above grade line 38 is somewhat arbitrary, but at least 18 inches is believed desirable in order to achieve sufficient moisture protection for the front wall from any moisture which may collect and puddle along grade line 38.

Stucco 47 is applied to the front face of parapet wall 24 to the underside 48 of the roof overhang and to the entirety of front wall 21 which is above grade line 38. The surfaces receiving stucco have a two-inch "Styrofoam" layer against the poured concrete surfaces. Next a wire lathe and finally the stucco is applied. The use of stucco is only one option for the exposed exterior of house 20, but is believed to be preferred due to its freedom of application and the nature of the interface between the stucco and the concrete walls and surfaces. The roof, back wall and side walls also have sheets of two-inch thick "Styrofoam" applied directly to the concrete and adhesively anchored in place. Next, along those surfaces to be covered by earth, plastic film 40 is applied.

Parapet wall 24 is covered with film 40 along its back surface and top edge and a sheet metal, vinyl-coated U-shaped cap 48 is applied over the top edge of wall 24 to secure the protective layers in place. Cap 48 is applied with a minimum four-inch adhesive joint on both the front and back surfaces of the parapet wall. Inside corner 49 is provided with a "Styrofoam" filler 50 which reduces the sharpness of the fold for film 40 and assures a better adhesive bond of the film to the "Styrofoam" at this corner location. Similar fillers are provided at other corner-joint locations. Sheet 53 extends from the parapet wall toward the back wall and ends at joint 44. The underneath sheet 54 of joint 44 extends to vent 32 where a circular joint around the vent exists. Sheet 55 of plastic film 40 is wrapped around vent 32 and outwardly flared at its base to extend beyond the vent and overlap with sheets 54 and 56 at the roof level. Top grade line 57 is included to suggest a positional relationship between the house height and earth thickness on roof 31. Sheet 56 extends to the back wall and folds over the edge and continues down back wall 34 to another joint 44. The underneath sheet 58 of joint 44 extends beneath floor 33 to complete the surrounding of house 20 in the detailed moisture barrier system. Each plastic-film-to-plastic-film-joint has a four-inch minimum overlap and a plastic adhesive (sealant) is applied to each surface of this overlapping joint in order to preserve the waterproofing characteristics of the system and to securely hold the sheets of film together.

Although only a side elevation section view has been illustrated, it is to be understood that all exterior surfaces of house 20 which are sheltered or covered by earth are protected by sheets of plastic film which are securely sealed to each other and to the "Styrofoam" inner liners in order to preclude any conceivable chance of moisture entry. Those portions of the side walls which are not covered with earth only have plastic film on those portions which are likely to have prolonged contact with accumulated moisture.

Figure 3:
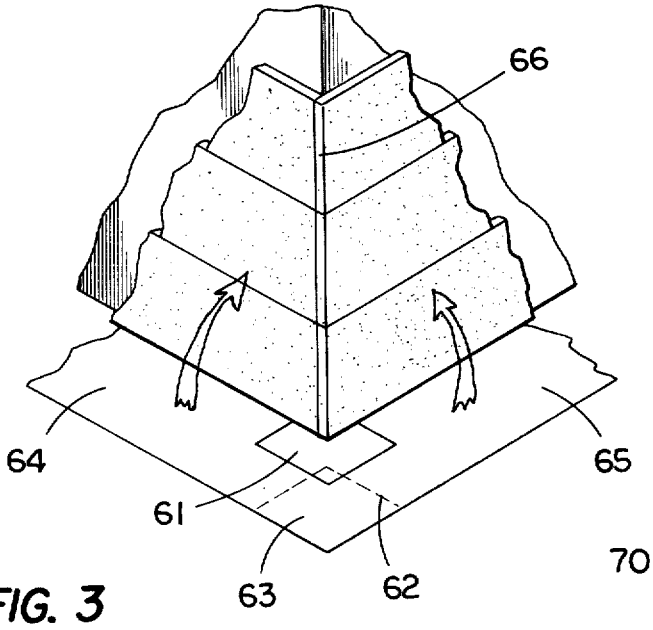
FIG. 3 is a diagrammatic perspective view of a corner joint configuration comprising a portion of the FIG. 1 earth-sheltered house.

Corner joint construction is illustrated in FIG. 3 wherein two-inch thick sheets of "Styrofoam" are applied to the poured concrete surfaces and the plastic sheet is laid out so as to extend well beyond the corner. An additional piece of film 61 is used as a reinforcer in the immediate location of the corner and trim line 62 indicates a cutting line for final trimming of the sheets as the joint is sealed. With piece 63 removed, sections 64 and 65 are folded upwardly as indicated by the arrows and overlap each other around corner edge 66 in order to form the corner joint for the film. The sheets of plastic film coming off from roof 31 overlap sections 64 and 65 with a four-inch minimum overlapping joint. Adhesive sealant is used at all joint locations and tape is used to hold the various overlapping sections of film in place while the adhesive cures.

In order to adapt the above moisture barrier system to house construction, there remains the need to input and exit various conduits and pipes for such utility-type needs as plumbing, electricity and gas. The passage of such conduits through the concrete walls, floors, and ceilings presents a critical point of sealing in order to preclude moisture entry at those locations. The strength or weakness of any system is governed by the strength of the weakest link and the benefits derived by the excellent moisture barrier system described above would be severely lessened if the sealed joints around entering conduits was not equally effective.

Figure 4:
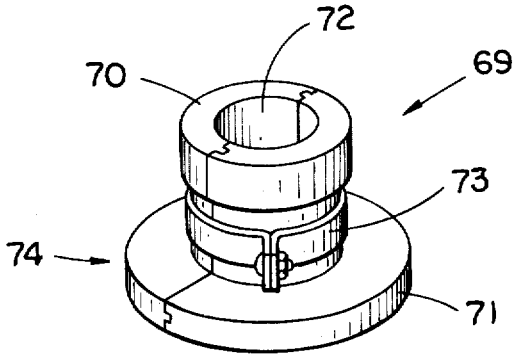
FIG. 4 is a perspective view of a conduit seal assembly comprising a portion of the FIG. 1 earth-sheltered house.

Referring to FIG. 4, a special conduit seal assembly 69 adapted for the present moisture barrier system is illustrated. Seal assembly 69 includes a first half member 70 and a compatibly configured second half member 71. Members 70 and 71 are semicylindrical and configured as if longitudinally split and have an interlocking edge design. Member 70 has an outwardly protruding tab along its diametral edge and member 71 has a compatible groove for a tongue-and-groove type of fit. The facing edges of the two members define a conduit passageway 72 which is circular in cross section and extends the full length of the seal assembly. Passageway 72 is sized according to the conduit diameter for which the seal assembly is intended. A steel band clamp 73 is fitted around the reduced diameter neck portion and is tightened in order to hold the two halves together. Two seal assemblies are used with each conduit, one assembly is contiguous to the plastic sheet on the concrete side and the other assembly is contiguous to the plastic sheet on the earth side. Enlarged semicylindrical base 74 is the portion of assembly 69 which is disposed against the corresponding sheet of plastic film and is located at one end of the sleeve portion which defines passageway 72.

Figure 5:
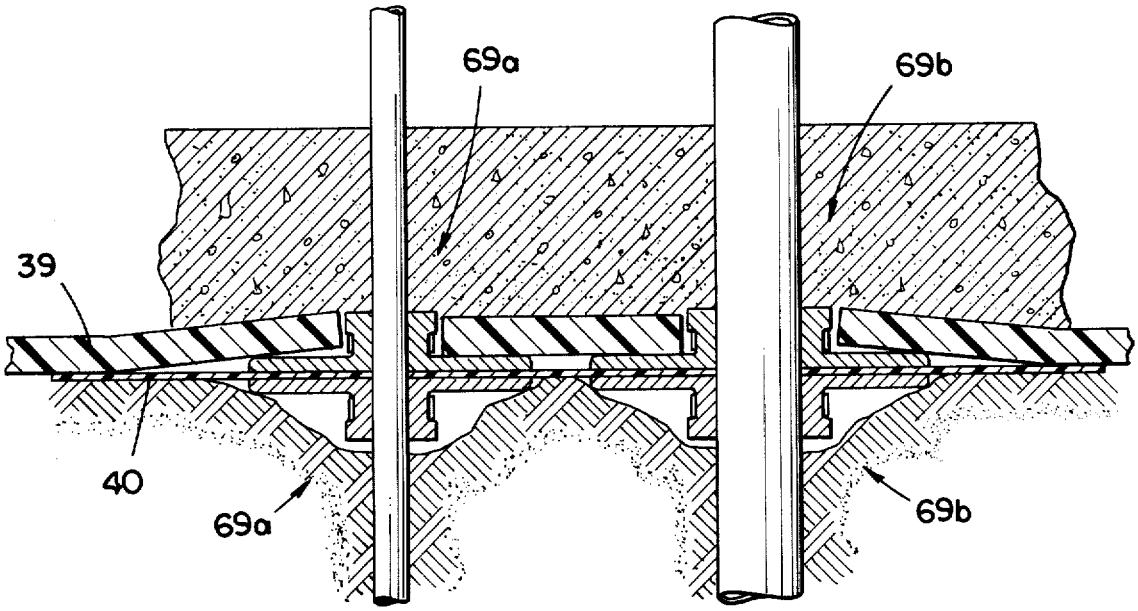
FIG. 5 is a partial side elevation section view of the FIG. 4 conduit seal assemblies installed as part of the FIG. 1 earth-sheltered house.

Referring to FIG. 5, the use of four seal assemblies is illustrated. Two assemblies **69*a* are sized for receipt of a typical water entry pipe or an electrical conduit. Assemblies 69*b* are of a size representative for receipt of a drain pipe or similar conduit. The base of each seal assembly is adhesively sealed to film 40 and passageway 72** is lined with adhesive such that all joint and seam interfaces are water-tight. The poured concrete complements the water-tight sealing around the conduit as does the use of the second seal assembly on the opposite side of the plastic film.

While the choice of construction materials to achieve the moisture barrier system described herein may vary, the concepts disclosed are envisioned to achieve the primary function of protecting those concrete surfaces surrounded by earth from moisture contact. This primary function is achieved by the use of heavy, plasticized sheets of synthetic material which are uniquely applied to the concrete walls and sealed to themselves at each seam joint. An additional attribute of the system disclosed is the providing of uniquely arranged, clamped seal assemblies to enable entry of pipes and conduits through the concrete walls in a water-tight manner.

While the details of the waterproofing (moisture barrier) system have been disclosed herein, it should be understood that certain otherwise conventional construction techniques may need to be modified in order to be compatible. One such technique involves the leveling of concrete which is poured for the floor of the structure. Conventionally, support stakes are pounded into the ground and guide rails or runners are supported thereon at a uniform height. A leveling bar (such as a two-by-four) is then drawn across the poured concrete at the desired height level by running this leveling bar across the top surface of oppositely positioned guide rails. This leveling procedure is referred to as screeding and the leveling bar is referred to as a screed. Thereafter, the guide rails are removed, their voids are filled, and the poured slab of concrete is completed.

In order to manage the volume of concrete poured and to be able to manipulate the leveling bar, a span between stakes (guide rails) of 8 to 10 feet is considered maximum. For this reason, even when the perimeter of the entire floor is open and accessible, stakes must be pounded into the ground at several points, interior to the area of the floor. An alternative configuration to the pounding of such stakes into the ground is presented by the Rohrer U.S. Pat. No. 4,115,976, which has been mentioned as part of the background discussion of the present invention. In the Rohrer patent, stakes of a conventional nature are not used but instead, a telescopically configured arrangement of sleeves and rail support members are used and the sleeves are anchored in place by digging a hole into the ground and securing the sleeve in the hole by means of cement. Whether stakes are pounded into the ground or sleeves are supported in the ground such as in Rohrer, the concret is still poured directly onto a layer of gravel which is directly atop the earth's surface and no problem results from the use of such stakes or holes because there is no particular system integrity to be preserved between the earth and the concrete. However, when a moisture barrier is established between the earth and the poured concrete, stakes pounded into the ground or other holes placed in the ground result in a puncturing or discontinuity to the plastic sheeting and thus destroys system integrity. For this reason, alternative means must be generated to enable leveling of the concrete in earth-sheltered housing construction when a moisture barrier (such as a plastic sheeting) is applied.

Figure 6:
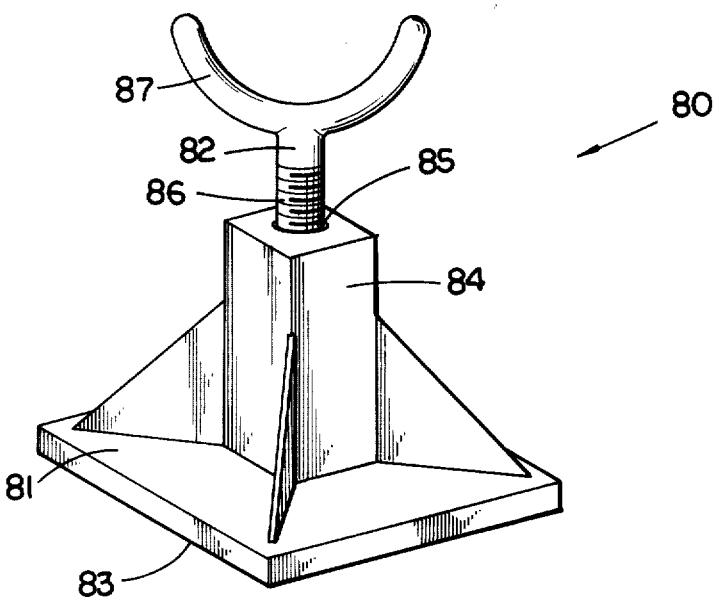
FIG. 6 is a perspective view of a concrete-leveling device suitably configured for use with embodiments of the present invention.

Referring to FIG. 6, a suitable leveling device 80 is illustrated and includes a base 81 and adjustable support collar 82. Base 81 has a substantially flat bottom surface 83, a central raised column 84 with an internally threaded aperture 85 therein. While base 81 and column 84 are rectangular solids, virtually any shape is compatible with the teachings herein, so long as the corresponding surface is substantially flat and aperture 85 is centrally positioned (for balance and stability) and so long as its longitudinal axis is substantially perpendicular to the plane of the bottom surface.

Support collar 82 has a lower, threaded end 86 and a part-circular cradle 87 joined to the threaded end. By clockwise or counterclockwise rotation of collar 82, the elevation of the cradle relative to surface 83 is changed. Consequently, regardless of the number of devices used or the desired height, all devices can be precisely set for the production of a very flat poured concrete slab. In the exemplary embodiment, the material used for the construction of device 80 is polyvinylchloride (PVC). Related synthetic materials may be used which are compatible with the material properties of the "Styrofoam" or alternatively, the plastic sheeting which is used for the moisture barrier. Material property compatibility is important so that the devices can be adhesively bonded to the "Styrofoam" or sheeting, whichever is disposed directly below the concrete. The reference to "Styrofoam" or sheeting is due to the fact that either material may be placed in direct contact with the poured concrete. In the FIG. 2 illustration, a sheet of "Styrofoam" abuts the concrete, but variations are envisioned and some consideration must be given to the material for device 80, depending upon such variations.

Figure 7:
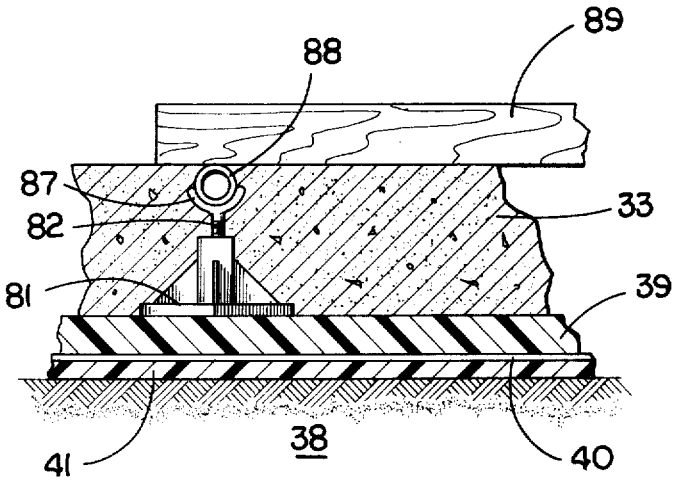
FIG. 7 is a partial, fragmentary front elevation view of the FIG. 6 device combined as part of the FIG. 2 arrangement.

Referring to FIG. 7, one leveling device 80 is positioned in its intended manner. With surface 83 bonded to a sheet of "Styrofoam" 39, collar 82 is oriented at a selected height. A 1½ inch diameter pipe 88 is placed within cradle 87. The top edge of pipe 88 establishes the poured concrete depth and also functions as a guide or rail for the leveling bar 89 (screed) to be drawn across. In the exemplary embodiment, this screed is a wooden two-by-four.

The curvature of the cradle is sized relative to selected pipe diameter so that there is a clearance fit, but still very little room for side-to-side roll or movement of pipe 88. Levels can be used between adjacent pipes to assure that all are set at approximately equal heights. Thereafter, the concrete is poured and the excess is skimmed as part of the screeding operation. As this is being done, the pipes can be drawn along with the leveling bar and ultimately removed. Excess concrete is used to fill the small voids created when the pipes are removed. The leveling devices remain adhesively joined to the "Styrofoam" and are completely submerged within the poured concrete.

The leveling of the concrete can thus be accomplished in a precise and accurate manner without puncturing the moisture barrier. The individual concrete sections which are leveled do not require an excessive span nor elaborate and expensive equipment. The edge perimeter of the floor is not required to be used as part of the leveling procedure and this provides some additional versatility to the construction contractor. While leveling device 80 is believed to be a novel and beneficial addition to construction work generally, it is quite important to the construction work involved with earth-sheltered housing.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A moisture barrier system for earth-sheltered housing and similar earth-contacted surfaces comprising:

a plurality of single layer sheets of plastic film applied to all of the exterior surfaces of said housing that are in contact with earth, said exterior surfaces comprising a floor, ceiling and side walls, adjacent sheets of plastic film being joined to each other at overlapping joints, and a plurality of pairs of conduit seal assemblies, at least one pair being located at each point of entry of conduits into said earth-sheltered housing, each conduit seal assembly of each pair being aligned with the other assembly of that pair each on opposite sides of said sheets of plastic film and being sealingly joined to said sheets of plastic film.

2. The moisture barrier system of claim 1 wherein each of said conduit seal assemblies includes two longitudinally-split halves defining an interior conduit passageway and a band clamp holding said halves together around a corresponding conduit.

3. The moisture barrier system of claim 1 wherein each sheet of plastic film is fabricated out of a polyvinylchloride material of between 0.030 and 0.050 inches in thickness.

4. The moisture barrier system of claim 1 wherein each overlapping joint between adjacent sheets of plastic film is at least three inches in overlap dimension and an adhesive sealant is disposed between the overlapping portions.

5. The moisture barrier system of claim 1 which further includes a plurality of sheets of rigid cushioning foam disposed between said sheets of plastic film and the earth-sheltered exterior surfaces of said housing.

6. The moisture barrier system of claim 6 wherein said sheets of rigid cushioning foam are adhesively joined to the earth-sheltered exterior surfaces of said housing and said sheets of plastic film are adhesively joined to said sheets of rigid cushioning foam.

7. In combination:

an earth-sheltered house including a roof, a floor, a front wall, a back wall and two side walls, said roof, back wall and portions of said side walls being earth-covered;

a plurality of single layer sheets of plastic film applied to all of the exterior surfaces of said roof, floor, back wall and side walls which are in contact with earth, said sheets of plastic film being arranged in overlapping side-by-side and end-to-end configurations between said earth sheltered house and said surrounding earth; and a plurality of pairs of conduit seal assemblies, there being at least one pair of conduit seal assemblies located at each point of entry of a conduit into said earth-sheltered housing, each conduit seal assembly of each pair of assemblies being sealingly joined around said entering conduits and sealingly joined to corresponding sheets of plastic film and aligned with the other assembly of that pair of assemblies.

8. The combination of claim 7 which further includes a plurality of sheets of rigid cushioning foam disposed between said sheets of plastic film and the earth-sheltered exterior surfaces of said house.

9. The combination of claim 8 which further includes a parapet wall located at the front edge of said roof, said parapet wall forming a barrier for the earth on said roof, the earth-covered side of said parapet wall being covered by corresponding sheets of said plastic film.

10. The combination of claim 8 wherein said floor includes a poured concrete slab and the combination further includes a plurality of leveling devices secured to said sheets of rigid cushioning foam which correspond to said floor, each leveling device being adjustable in height and suitably configured to receive a guide rail for use in concrete leveling of said floor.

* * * * *